US006439835B1

(12) United States Patent
Chien et al.

(10) Patent No.: US 6,439,835 B1
(45) Date of Patent: Aug. 27, 2002

(54) PUMP SHELL FOR MULTISTAGE METAL WORKING PUMP

(76) Inventors: Huan-Jan Chien, No. 9, Ln 189, San Chung Rd., San Chung Li, Chutung Town, Hsinchu (TW); Pao-Yin Ou, No. 79, Nan Ning Rd., Chutung Town, Hsinchu (TW); Shu-Fen Kao, 2F, No.11, Aly. 10, Ln. 207, Sec. 3, Hsing Lung Rd., Taipei (TW); Rong-Jau Liaw, 3F, No. 6, Ln. 42, Tung Kuang Rd., Hsinchu (TW)

( * ) Notice: Subject to any disclaimer, the term of this patent is extended or adjusted under 35 U.S.C. 154(b) by 118 days.

(21) Appl. No.: 09/643,860

(22) Filed: Aug. 23, 2000

(30) Foreign Application Priority Data

Aug. 23, 2000 (CN) ..... 089201923

(51) Int. Cl.[7] ..... F04D 1/06

(52) U.S. Cl. ..... 415/104; 415/172.1; 415/199.2; 415/200; 415/214.1; 415/215.1

(58) Field of Search ..... 415/172.1, 199.1, 415/199.2, 199.3, 200, 214.1, 215.1, 104

(56) References Cited

U.S. PATENT DOCUMENTS 2,816,509 A * 12/1957 Rice ..... 415/199.3
3,265,001 A * 8/1966 Deters ..... 415/199.3
3,402,670 A * 9/1968 Boyd ..... 415/199.2
4,678,399 A * 7/1987 Vandevier et al. ..... 415/104
4,741,668 A * 5/1988 Bearden ..... 415/199.1
5,133,639 A * 7/1992 Gay et al. ..... 415/172.1
5,234,317 A * 8/1993 Kajiwara et al. ..... 415/200
5,256,033 A * 10/1993 Kajiwara ..... 415/199.1
5,318,403 A * 6/1994 Kajiwara et al. ..... 415/199.1
6,106,224 A * 8/2000 Sheth et al. ..... 415/104
6,267,555 B1 * 7/2001 Chien et al. ..... 415/172.1

* cited by examiner

*Primary Examiner*—Christopher Verdier
(74) *Attorney, Agent, or Firm*—Troxell Law Office PLLC

(57) ABSTRACT

An improved pump shell for a multistage metal working pump includes a plurality of pump shell units housed in series within a hollow cylindrical casing and has the impellers driven by a shaft. Each pump shell unit has a inner shell which forms a holding end at one side and a sealing flange at another side. The holding end of one pump shell may align and engage precisely and easily with the sealing flange of an adjacent pump shell unit to form a smooth fluid passage from the inlet of the impeller through the inner shell so that pumping efficiency may be enhanced with less turbulence. The sealing flange, holding end and the casing also form a close annular compartment for holding a seal ring inside to provide effective sealing function. The pump shell may be produced by stamping at low cost.

7 Claims, 8 Drawing Sheets

PUMP SHELL FOR MULTISTAGE METAL WORKING PUMP

BACKGROUND OF THE INVENTION

1. Field of the Invention

This invention relates to an improved pump shell for a multistage metal working pump and particularly to a pump shell consisting of a plurality of pump shell units housed in a hollow cylindrical casing, each pump shell unit has an inner shell and an impeller, the inner shell has a novel positioning, and sealing structure to form a simple pump shell structure that may be made easily at low cost, and provide smooth fluid guiding with less turbulence and improved sealing.

2. Description of the Prior Art

Conventional multistage centrifugal pumps (such as submersible pumps, or also called as water-sunken pumps) mostly have a plurality of pump shell units and impellers stacked in series along a shaft. The shaft rotates the impellers against the pump shell and generates centrifugal force for fluid to flow in the passage through the pump shells. Traditionally, multistage pumps are made by casting. They are heavy, bulky, brittle, have low strength and lower pumping efficiency. Hence contemporary multistage pumps are increasing made by high strength and low weight metal working pumps.

The design consideration of a metal working pump usually includes cost of production and assembly, pumping efficiency, flow guide design, pressure resistance, sealing effect, and etc. Conventional metal working pumps seldom can totally make all of aforesaid factors to the optimum level.

For instance, EU Patent application No. 81110541 suggests a pump shell design shown in FIG. 1. It has a casing 11 made by a metal working process. Inside the casing 11, there are partition members 12 to form multistages 2 desired. Each stage 2 of the casing 11 includes an impeller 3 and baffles 20. The casing 11 of a stage 2 has a curved portion 19 formed in the circumference at a rear rim 111 for engaging with a front end of inner side 112 of an adjacent stage and to form an annular space therebetwen to squeeze a seal ring 14 therein. While it makes assembly of a multi stage pump easier, the fabrication of the curved portion 19 and front end 112 cannot always reach the precision required, and may result in not precise engagement between the two stages. Pumping thrust force and vibration may also cause deformation of the rim 111 and make the seal ring 14 become not effective for sealing function. Furthermore inside the casing 11, there is no smooth fluid guide in the fluid passage between the impeller 3 and baffles 20 and may induce turbulence at the front end of the impeller and result in poor pumping efficiency. Hence it has the disadvantages of poor axial alignment, poor sealing and lower pumping efficiency.

FIG. 2 shows another prior art of metal working pump disclosed in U.S. Pat. No. 5,234,317 which has a pump casing 21 made by pressing and stamping. The pump casing 21 has a U-shaped end rim 211 for engaging with another end of an adjacent stage pump casing. As the sealing area between the end rim 211 and another end is relatively small, the sealing effect is not good when subject to great pumping pressure or vibration. Furthermore, the casing 21 should be made by hydraulic or oil pressing, its cost is higher. And there is also no smooth fluid passage between the impeller and the baffles. It also is prone to produce turbulence and result in lower pumping efficiency.

FIG. 3 shows a further prior art of a metal working pump casing now available in the market place. It has a metal working shell 4 consisted of a front outer shell 41, a rear outer shell 42, a front inner shell 43, a rear inner shell 44, a diffuser 45, an impeller hub 46, a front seal ring 47 and an impeller (not shown in the figure). The front outer shell 41 has a front end plate 413, an indent axial holding side 411 and a radial holding side 412. The rear outer shell 42 has radial holding ends 421 and 422 for engaging respectively with the axial and radial sides 411 and 412 of an adjacent pump shell, and a holding end 441 for making contact with the front end plate 413 of the adjacent pump shell. The positioning and sealing effect is simpler and more effective. The curved inner portion of the front and rear inner shell 43 and 44 also may produce more streamline fluid flow and offers improved pumping efficiency. However it still has the following disadvantages:

1. Too many components. As shown in FIG. 3, the pump casing 4 has a total of eight components, including the front and rear outer shells 43, 44, diffuser 45, impeller hub 46, front seal ring 47 and impeller. It needs more molds and fabrication processes to produce. The cost becomes much higher. It also takes more assembly time and becomes more expensive.

2. It needs more precise machining. The engagement and sealing function between the holding ends 421, 422 and holding sides 411, 412 need more precise dimensions which cannot be made by conventional stamping or pressing operation. Extra machining work should be done. It increases production time and cost. The machining also makes the pump shell thinner and may reduce pump shell strength.

3. The front shells 41, 43 and rear shells 42, 44 should be joined by circular soldering at circular solder points 48. It costs much higher than spot soldering. Circular soldering also produces a not smooth or sightly appearance and inaccurate dimensions. It makes assembly more difficult. The soldering portion may temper material strength and needs extra machining work to reach dimension desired, and may result in a thinner pump shell and lower strength.

There are many other prior arts being disclosed, such as U.S. Pat. Nos. 4,877,372, 5,082,425, 5,344,678, 5,425,618, 5,201,848, 5,133,639, EU Pat. No. 0 492 575A1, 0 257 358A2, Pct No. WO 94/23211, DE Pat. No. 44 46 193C2. All of the above prior arts have some drawbacks and cannot fully satisfy the aforesaid design considerations such as production and assembly cost, enhanced flow passage and pumping efficiency, better pressure resistance and more effective sealing.

SUMMARY OF THE INVENTION

It is an object of this invention to provide an improved metal working pump shell for a multistage pump that has a fewer number of components, may be made and assembled at a lower cost, has strong pressure resistance and improved sealing.

It is another object of this invention to provide an improved metal working pump shell that may be used for a pump with a floatable impeller. The pump shell according to this invention includes a plurality of pump shell units stacked in series on a rotatable shaft. Each pump unit includes at least a hollow inner shell, an impeller, a sealing ring and a diffuser. The rotating shaft rotates the impeller in the shell for drawing fluid from an impeller inlet and discharging fluid to another pump unit at another stage.

The inner shell has an inner end which has one side fixedly engaged with the diffuser, an inner shell side formed with a curved connection with the inner end, and a step and taper holding end to form a curved connection with the inner shell side. Fluid flows into the impeller through an inlet at the holding end, passing around the curved connection of the inner shell side and through the outlet of the diffuser to be discharged into another impeller of the next adjacent pump unit. More than one pump unit is housed inside a hollow cylindrical casing.

The inner end may attach from its outside surface a holding ring which forms a sealing flange at one end to make a close engagement with the holding end of the next stage pump unit so that two pump units may be aligned and assembled easily and accurately. The holding end, and inner end and casing form a close compartment to hold and squeeze the seal ring therein for preventing leaking.

The impeller is floatable and has a rear wall mounted on an impeller hub and a front wall with an impeller front thrust ring attached thereon. The impeller hub has an impeller metal working member soldering with the rear wall of the impeller and an impeller plastic member mounting on the shaft and supporting the impeller metal working member. The impeller front thrust ring includes a thrust metal working member soldering to the front wall of the impeller around the impeller inlet and a thrust plastic member mounted on the thrust metal working member.

The holding ring also has a holding metal working member and a holding plastic member mating against the thrust plastic member of an adjacent pump unit to absorb axial thrust force during pumping operations.

The impeller hub is axially movable on the shaft and thus forms a floatable impeller that may move to a desired distance when subject to pumping thrust force.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
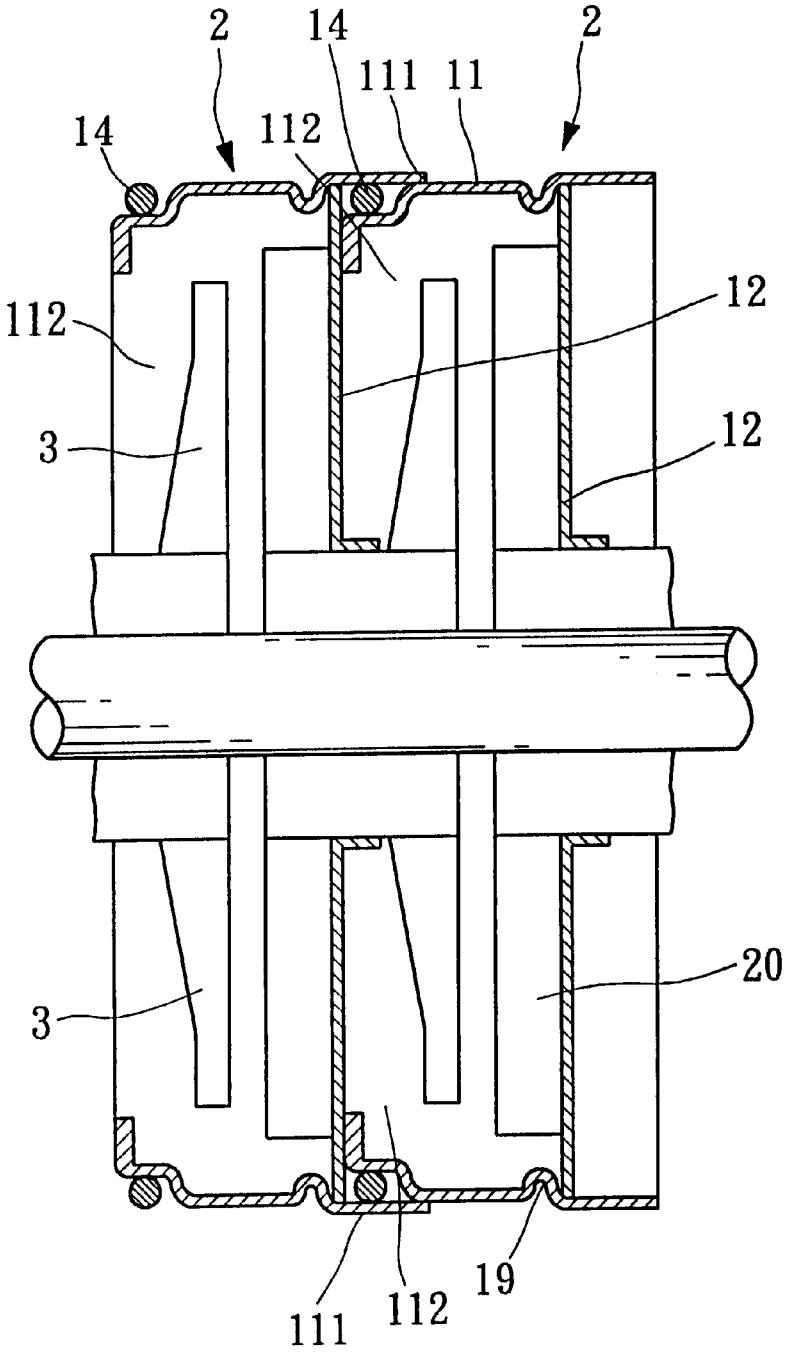
FIG. 1 (PRIOR ART)
FIG. 1 is a sectional view of a conventional metal working pump casing for a multistage pump.
Figure 2:
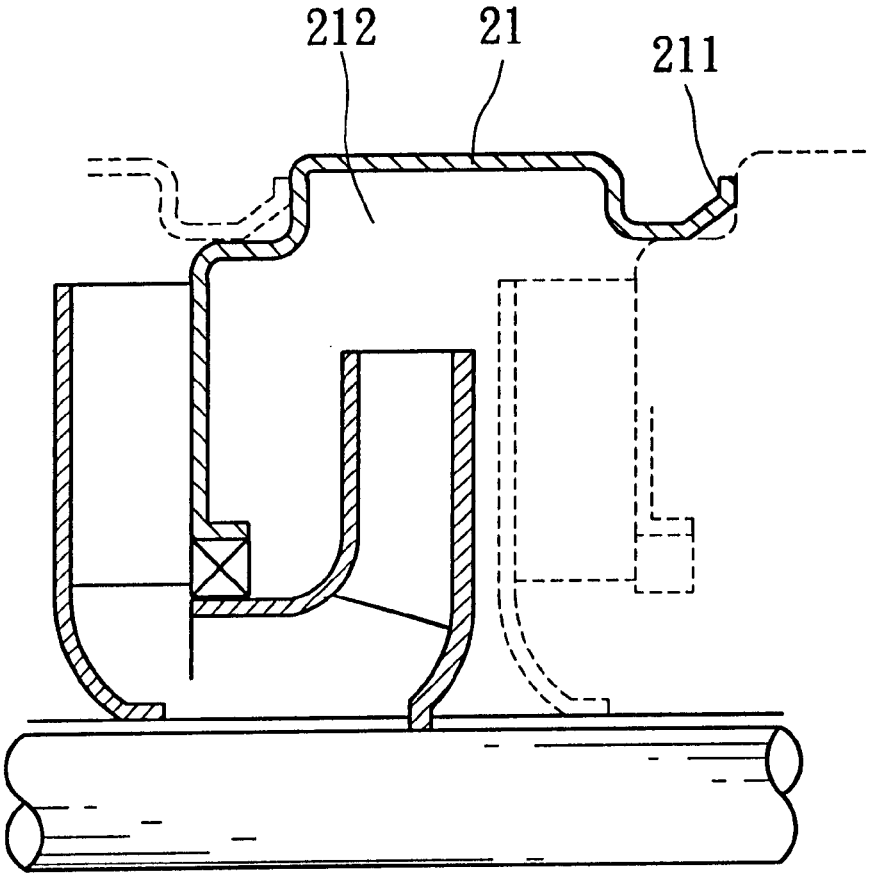
FIG. 2 (PRIOR ART)
FIG. 2 is a sectional view of another conventional metal working pump casing for a multistage pump.
Figure 3:
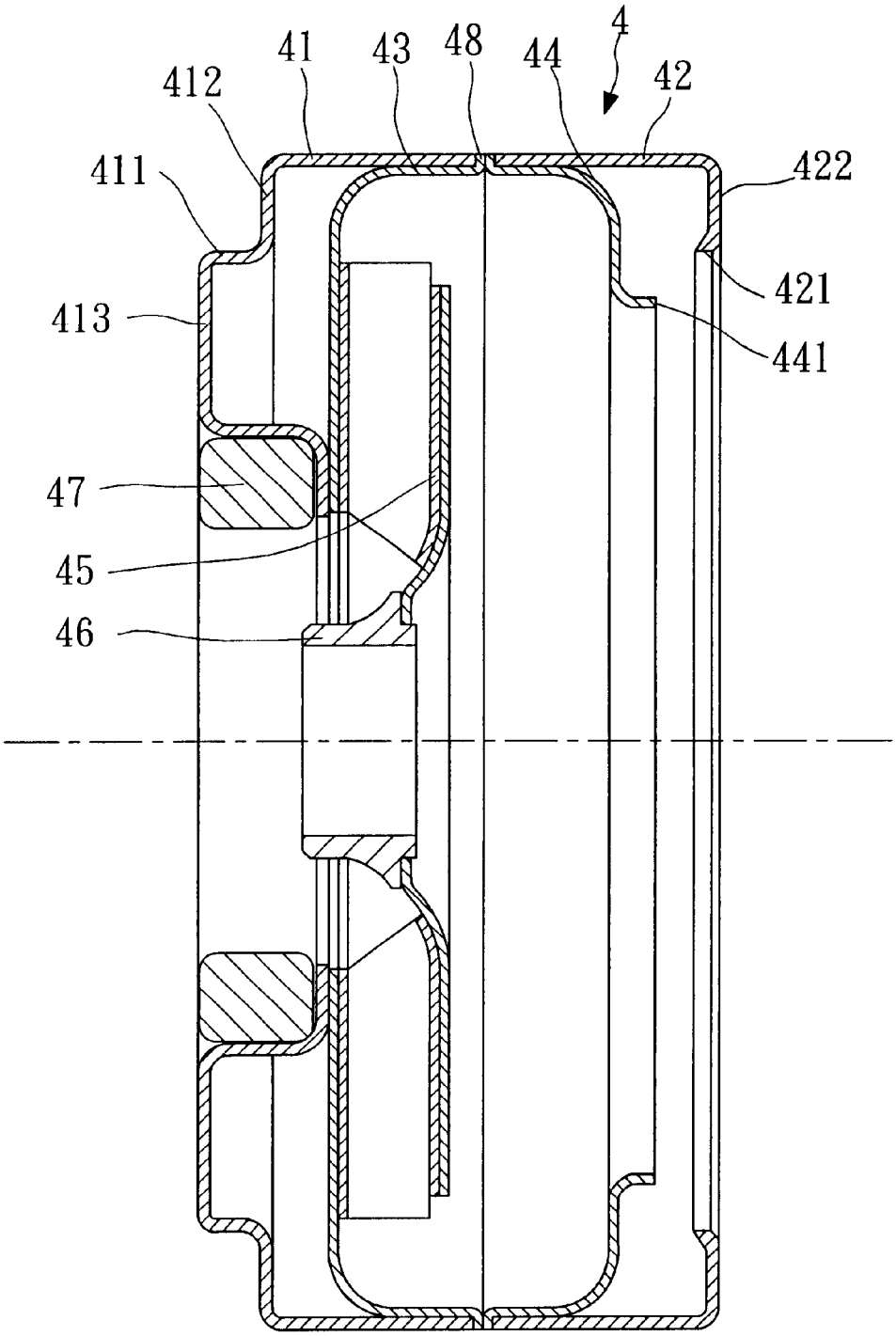
FIG. 3 (PRIOR ART)
FIG. 3 is a sectional view of a further conventional metal working pump casing for a multistage pump.
Figure 4:
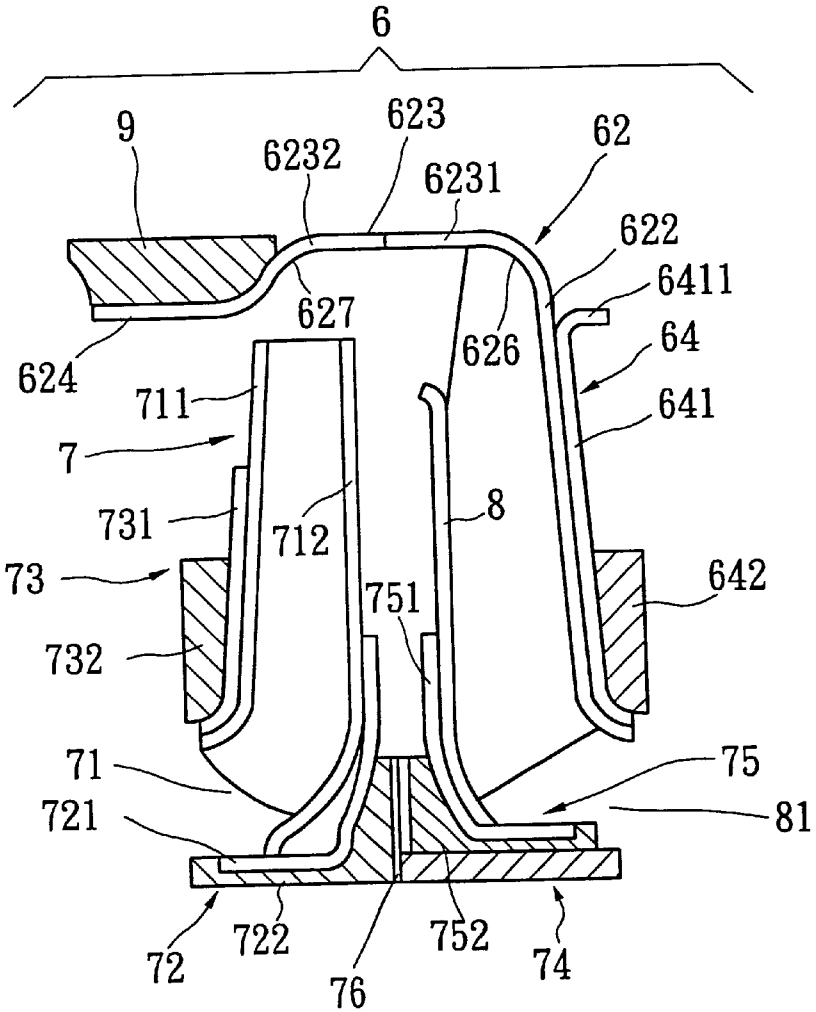
FIG. 4 is a sectional view of a pump shell for a single stage pump of this invention.
Figure 5:
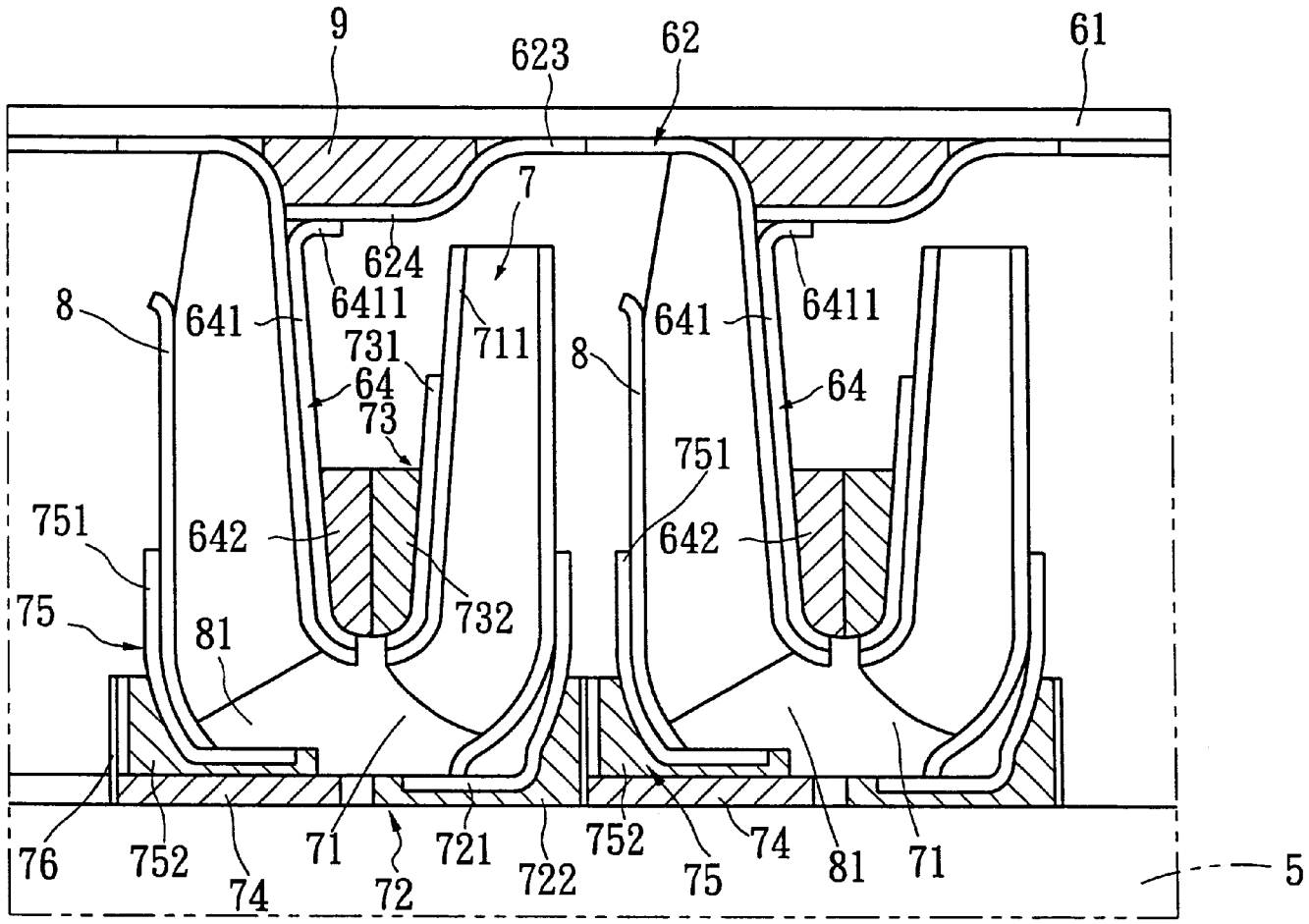
FIG. 5 is a fragmentary sectional view of this invention shown in FIG. 4 including two pump shells for a two stage pump.

Referring to FIGS. 4 and 5, the multistage pump according to this invention includes a plurality of pump shell units 6 mounted in series on a shaft 5. Each pump shell unit 6 includes at least one hollow inner shell 62, an impeller 7, a seal ring 9 and a diffuser 8. The shaft 5 drives the impeller 7 to rotate in the inner shell 62 to draw fluid into the impeller from an inlet 71 through the diffuser 8 and discharge out through a diffuser outlet 81 to a pump shell unit of the next stage.

The inner shell 62 has one inner end 622 attached with the diffuser 8 and extended radially outward to form a curved flow guide 626 then extended substantially parallel with the shaft 5 to become a front section 6231 of an inner shell side 623. Then the inner shell side 623 has a rear section 6232 extending from the front section 6231 and forming another curved flow guide 627 to become a step and taper inward holding end 624 which is also parallel with the shaft 5. The front and rear section 6231 and 6232 are joined by spot soldering at desired intervals to form the inner shell 62.

The curved flow guides 626 and 627 form a smooth fluid passage between the impeller 7 and the diffuser 8 so that interference may be avoided and pumping efficiency may be improved. When two or more pump shell units 6 are stacked to form a multistage pump, the front end of the holding end 624 makes close contact with the inner end 622 of next pump to form a close fluid passage within the pump between the diffuser 8 of the next stage.

The impeller 7 shown in FIGS. 4 and 5 is a floatable impeller consisting of a plurality of blades (not being marked in figures) sandwiched between a front wall 711 and a rear wall 712 and an impeller hub 72 for mounting the rear wall 712, and an impeller front thrust ring 73. The impeller hub 72 includes a integrally formed metallic impeller metal working member 721 mounting on the rear wall 712 by soldering and an impeller plastic member 722 having a shaft hole (not being marked) for engaging with the shaft 5 to transmit rotation power. The impeller front thrust ring 73 includes an integrally formed metallic thrust metal working member 731 soldering to the front wall 711 and a thrust plastic member 732 located at a lower front end of the thrust metal working member 731 and the inlet 71.

The pump shell unit 6 further has a plastic shaft sleeve 74 mounted on the shaft 5 and a diffuser collar 75 which is integrally made of a metallic diffuser metal working member 751 for soldering to a front side of the diffuser 8 and a diffuser plastic member 752 which has a center opening to surround the shaft sleeve 74 which serves as a bearing to rotate along with the shaft 5 against the stationary diffuser plastic member 752. Between the impeller plastic member 722 and the diffuser plastic member 752, there is an annular bakelite ring 76 mounting on the shaft 5.

The impeller 7 may slightly move axially along the shaft 5 when a subject to fluid thrust pressure coming front the inlet 71. It hence is called a floatable impeller structure.

When in use, a plurality of pump shell units 6 are stacked in series on the shaft 5 and housed inside the hollow cylindrical casing 61 to form a multistage pump. The inside diameter of the holding end 624 is slightly larger than the outside diameter of the sealing flange 6411. The holding end 624 may engage easily and precisely with the flange sealing ring 641 of the holding ring 64 of another adjacent pump shell unit. The outside surface of the holding end 624 and inner end 622, and the inside wall of the casing 61 form together a close sealing compartment to house the seal ring 9 therein to get effective sealing. The holding plastic member 642 faces against the thrust plastic member 732 to provide low friction thrust absorbing function during pumping operation.

In addition to the floatable impeller 7, this invention may also be used equally well for a high speed ratio diagonal pump and non-floatable multistage pump. The following illustrates a few examples. Most components are similar as the one shown in FIG. 4 and will be omitted. Only main different parts will be indicated.

Figure 6:
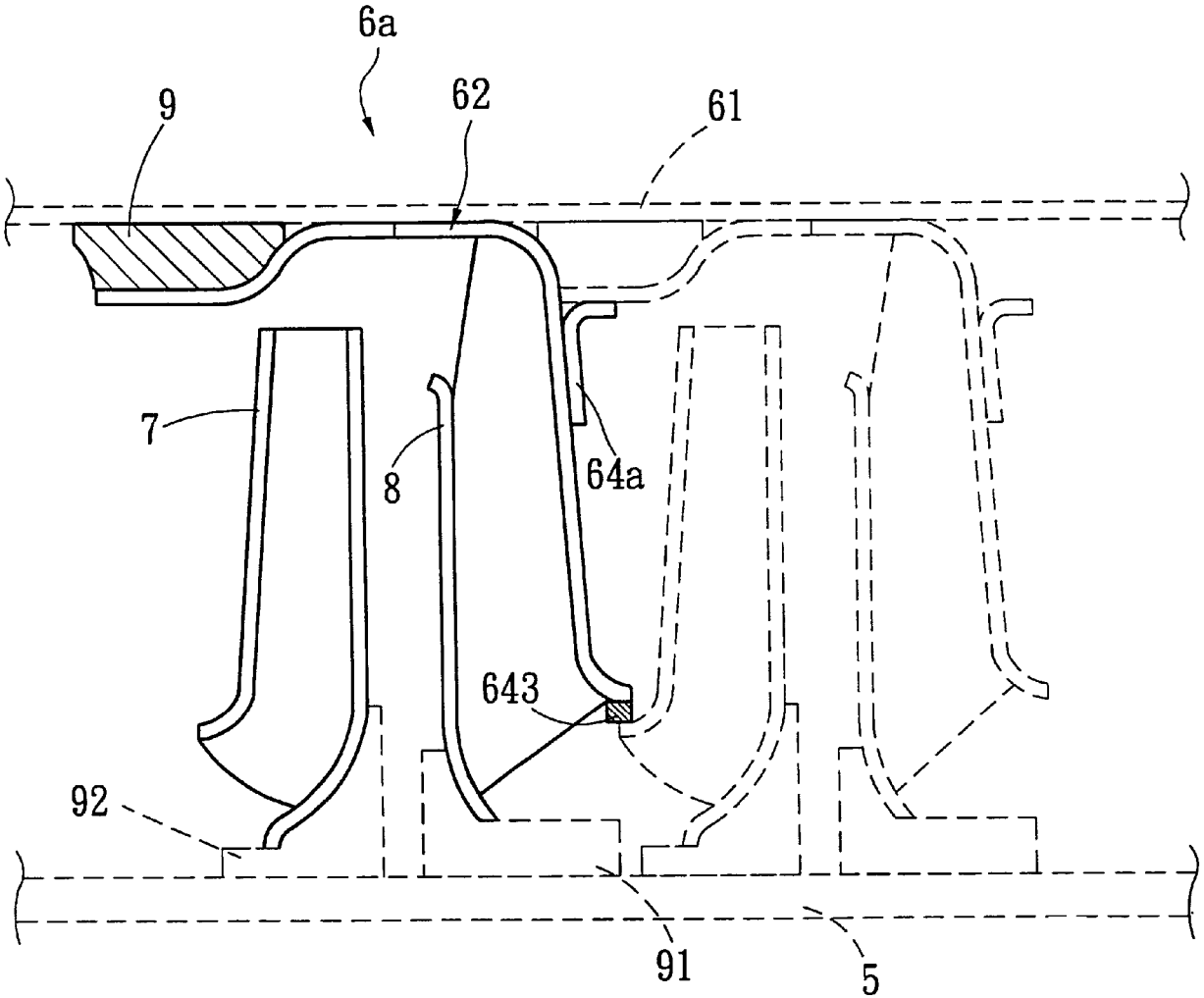
FIG. 6 is a sectional view of a pump shell of another embodiment of this invention for a non-flotable impeller.

FIG. 6 shows an embodiment of using this invention on a non-floatable pump. It has a casing 61 which houses a plurality of pump shell units 6*a* therein. Each pump shell unit includes an inner shell 62, a diffuser 8, and a seal ring 9. The impeller 7 and diffuser 8 are respectively mounted on a non-movable impeller hub 92 and diffuser hub 91, and mount around the shaft 5. As the impeller 7 is not movable axially, the holding plastic member and thrust plastic member shown in FIG. 5 may be dispensed with. A smaller size of holding ring 64*a* may be sufficient for positioning and alignment of pump shell use. A seal ring 643 may be set between the inner shell 62 lower end and the impeller front wall lower end to keep fluid passage in a desired direction.

Figure 7:
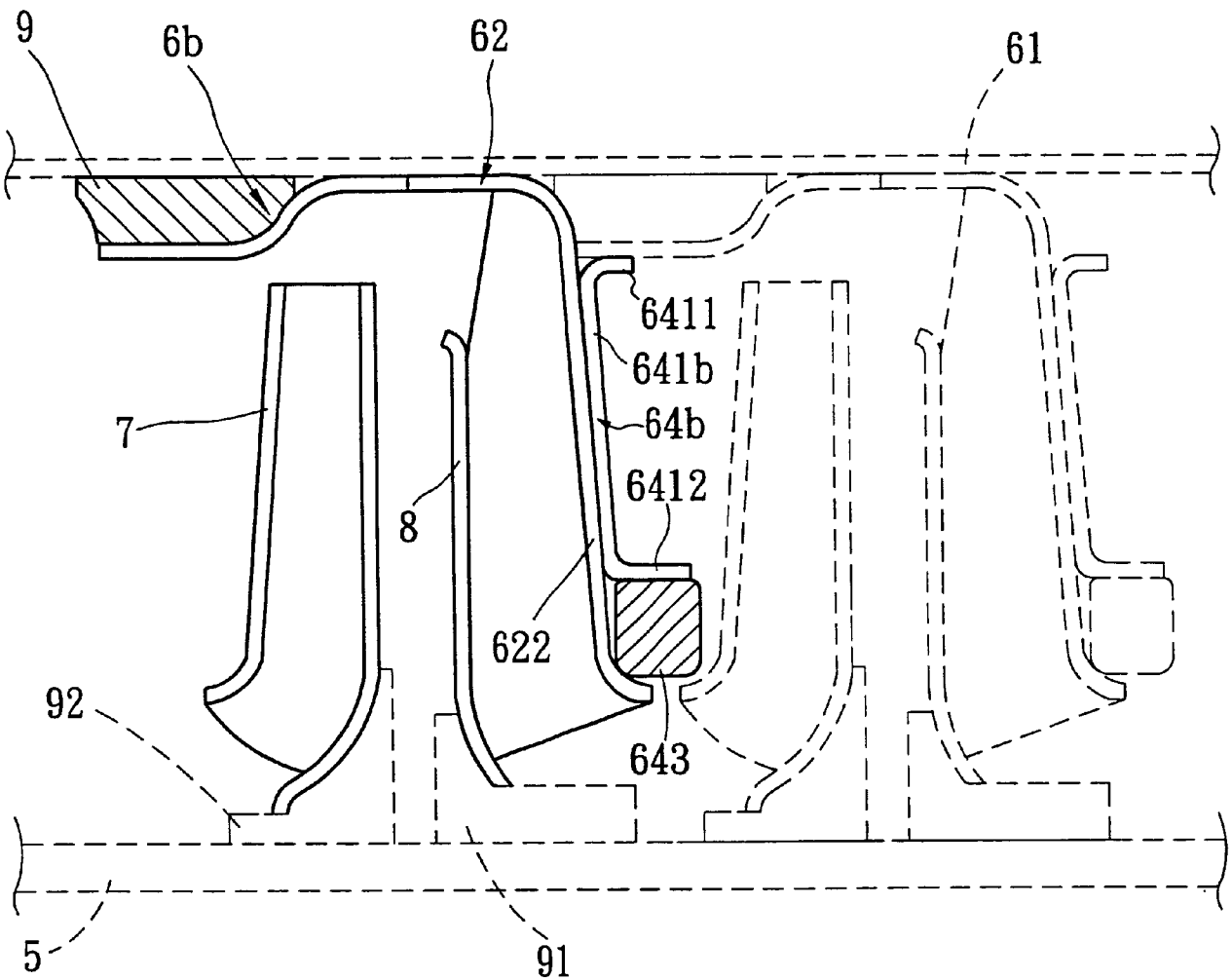
FIG. 7 is a sectional view of a pump shell of a further embodiment of this invention for a non-floatable impeller.

FIG. 7 shows a further embodiment for a non-floatable impeller multistage pump and which is largely constructed like the one shown in FIG. 6. However the holding ring 64*b* of the pump shell unit 6*b* has a sealing flange 6411 of flange sealing ring 641*b* at the upper end and a sealing flange 6412 at the lower end to hold a seal ring 643 thereunder against a lower end of the inner end 622.

Figure 8:
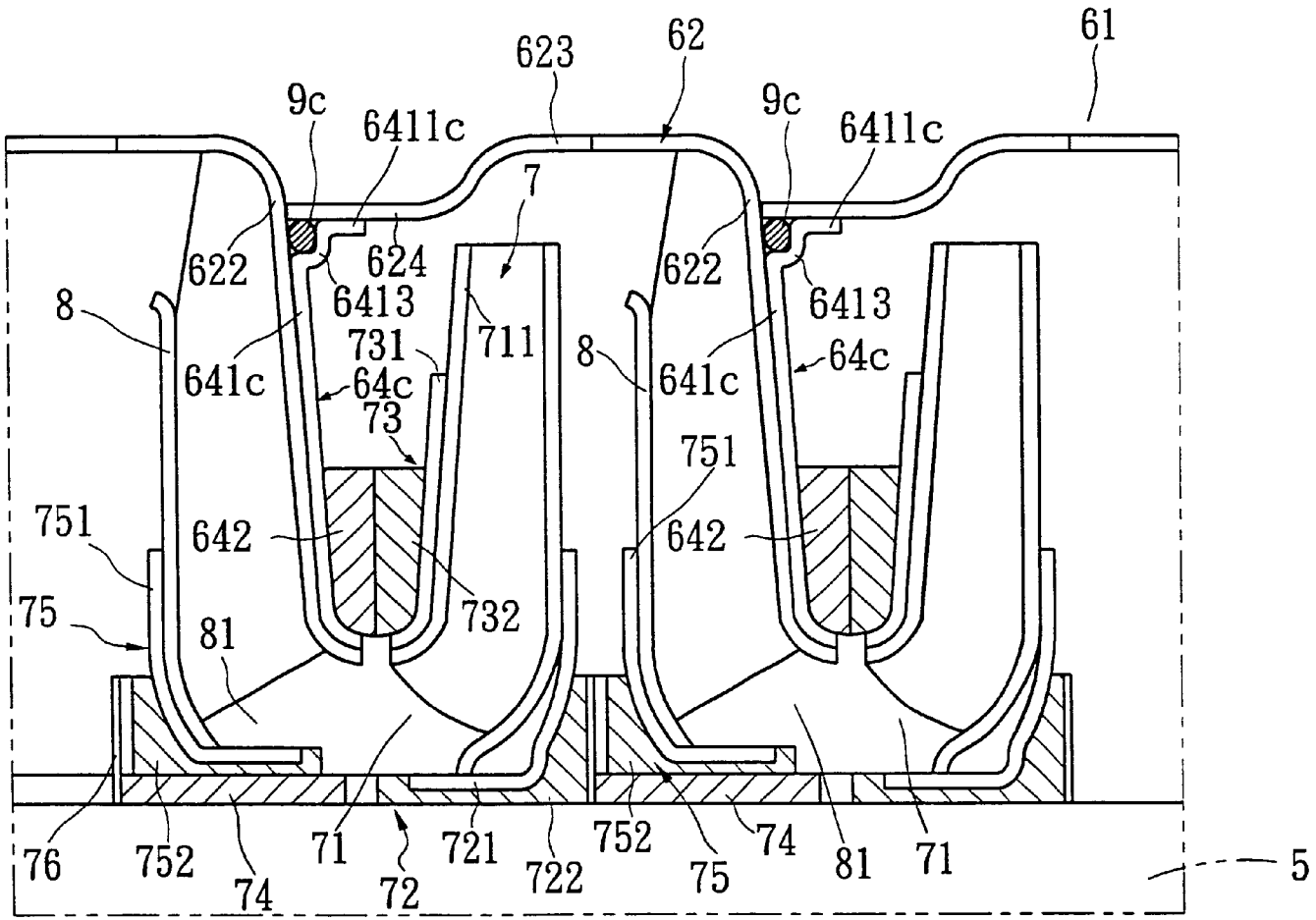
FIG. 8 is a fragmentary sectional view of an even further embodiment of this invention which includes two pump shells for a two stage pump.

FIG. 8 illustrates yet an even further preferred embodiment of the present invention. The pump shell units shown in FIG. 8 are very similar to the ones illustrated in FIG. 5. The only differences between these two embodiments are that the flange sealing ring 641*c* of the holding ring 64*c* is formed with a step-shaped portion 6413 at an outer rim area adjacent to the sealing flange 6411*c*. This step-shaped portion 6413 of the flange sealing ring 641*c* mates with the holding end 624 of an adjacent stage of pump shell unit 6 to form a closed sealing compartment for housing the seal ring 9*c* therein. The seal ring 9*c* has a size smaller than the one shown in FIG. 5. Therefore, the casing 61 of FIG. 5 can be dispensed with in this preferred embodiment since the seal ring 9*c* is well sealed among the step-shaped portion 6413, inner end 622, and holding end 624 of adjacent pump shell unit.

In summary, this invention offers the following advantages:

1. Smaller number of components. The casing 61 and pump shell unit 6 have simpler structure with less components. At least four molds may be saved comparing with conventional ones. The casing 61 may be mass produced by a hot or cold extrusion steel tube. Total production cost saving is significant.
2. Better alignment and sealing effect. The holding end 624 of one pump shell unit may be axially aligned with the flange sealing ring 6411 of an adjacent pump shell unit easily and precisely. The seal ring 9 may be held and squeezed in a closely formed compartment with enhanced leak-prevention effect. The smooth flow passage within the pump shell also may reduce turbulence and enhance pumping efficiency.
3. High pressure resistance structure. Using a cylindrical casing 61 to house the pump shell unit 6 inside effectively prevents external force from exerting on the pump shell unit. Each pump shell unit is subjected to a one stage pressure difference with minimum deformation. Permeation and pressure resistance is much higher than a conventional type multistage pump which does not have the cylindrical tube casing 61 as the outside wall.
4. No need for circular soldering.

As the pump shell units 6 are housed and shielded in the cylindrical casing 61, spot soldering of the inner shell 62 may produce sufficient bonding strength. Cost is much lower. The appearance is more sightly. Precision and dimension control is also better. The side effect of soldering such as down grade of material strength may also be avoided.

It may thus be seen that the object of the present invention set forth herein, as well as those made apparent from the foregoing description, are efficiently attained. While the preferred embodiment of the invention have been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. An improved pump shell for a multistage metal working pump, comprising:

a plurality of pump shell units housed in series within a hollow cylindrical casing and mounting around a shaft, each pump shell unit including:

an inner shell having a radial inner end, an inner shell side substantially parallel with the shaft, a first curved flow guide bridging the radial inner end and inner shell side, a step and taper holding end extending from the inner shell side, a second curved flow guide bridging the holding end and the inner shell side, a holding ring mounted on an outside surface of the inner end having a holding metal working member which has a top end formed with a sealing flange extending outward, the sealing flange having an outside diameter slightly smaller than an inside diameter of the holding end;

a diffuser mounted around the shaft having one side attached to an inside wall of the inner end and an outlet;

an impeller adjacent the diffuser and mounted on the shaft having a front inlet; and a seal ring held in an annular compartment formed by an inside wall of the casing, outside walls of the holding end, and the inner end for preventing fluid leaking or counter flow;

wherein the holding end of one pump shell unit may engage with the sealing flange of another pump shell unit to form a precise alignment and sealing for creating a fluid passage to enable pumping fluid flow smoothly from the inlet of one pump shell unit, through the impeller, first and second flow guide and to discharge out through the outlet of another pump shell unit when the shaft is driven to rotate the impeller.

2. The improved pump shell of claim 1, wherein the impeller has a front wall attached to an impeller front thrust ring at a front side which includes a thrust metal working member integrally formed with a thrust plastic member located thereon, and a rear wall fixedly mounted on a metallic impeller metal working member integrally formed on an impeller plastic member which has a shaft opening engaged with the shaft for transmitting rotation drive from the shaft to the impeller, and the impeller is axially movable along the shaft for a desired distance.

3. The improved pump shell of claim 2, wherein the holding ring has said holding metal working member integrally formed with a holding plastic member which faces against the thrust plastic member of another pump shell unit for absorbing thrust pressure force like a bearing during pumping operation.

4. The improved pump shell of claim 2 further having a plastic shaft sleeve mounted on and rotated with the shaft synchronously and adjacent the impeller plastic member; and a diffuser collar including a metallic diffuser metal working member integrally formed with a diffuser plastic member which has an axial opening to enable the shaft sleeve to rotate therein, and the diffuser is fixedly soldered on the diffuser metal working member.

5. The improved pump shell of claim 4, wherein the impeller plastic member and the diffuser plastic member have an annular bakelite ring located therebetween.

6. The improved pump shell of claim 1, wherein the inner shell has a front section and a rear section formed by stamping, the front section includes at least the inner end and about a half of the inner shell side, the rear section includes at least the holding end and about a half of the inner shell side.

7. The improved pump shell of claim 6, wherein the front and rear section are joined by spot soldering at an interval desired.

* * * * *